United States Patent [19]

Klaeger, Jr. et al.

[11] 4,086,035

[45] Apr. 25, 1978

[54] BAILER PUMPS FOR OIL WELLS

[76] Inventors: Joseph Hart Klaeger, Jr.; Dale Edward Klaeger; Robert Allen Klaeger, all of 1308 Shady La., Hondo, Tex. 78861

[21] Appl. No.: 779,180

[22] Filed: Mar. 18, 1977

[51] Int. Cl.[2] ..... F04B 17/00

[52] U.S. Cl. ..... 417/410; 166/53; 166/168; 417/12; 417/554

[58] Field of Search ..... 417/12, 410, 415, 554; 166/45, 53, 168

[56] References Cited

U.S. PATENT DOCUMENTS

| | | | |
|---|---|---|---|
| 1,145,158 | 7/1915 | Mapes | 166/168 |
| 1,523,604 | 1/1925 | Miller | 166/168 |
| 2,145,753 | 1/1939 | Coulter | 166/168 |
| 2,661,697 | 12/1953 | Long et al. | 417/410 |
| 2,956,511 | 10/1960 | Morehead | 417/415 |
| 2,990,780 | 7/1961 | Kreuter | 417/12 |
| 3,075,466 | 1/1963 | Agnew et al. | 417/12 |
| 3,963,374 | 6/1976 | Sullivan | 417/12 |
| 3,998,568 | 12/1976 | Hynd | 417/12 |

*Primary Examiner*—C. J. Husar
*Attorney, Agent, or Firm*—Willard J. Hodges, Jr.

[57] ABSTRACT

A bailer pump designed for securing to a well head comprising an elongated stan pipe projecting upward from the well head supporting a motor driving a reel for cable through a drive train incorporating a magnetic brake, when the current to the motor is interrupted the magnetic brake is activated. A bailer is propelled into and out of the well in a repititious controlled manner. The electrical control mechanisms operate in conjunction with a pivot arm mounted at the top of the stan pipe on an axle. Pillow blocks retain the pivot arm in a tilting position. Tension or lack of tension on the cable passing over the top pulley causes a reciprocal tilting of the pivot arm and the pulley. The tilting arm contacts a micro switch which through time delay and relays start, stop, and reverse the electric motor operating the cable reel. The short delay in the well permits filling of the bailer and a long delay at the well head permits unloading of the bailer. The long delay is energized by the bailer striking a bailer stop contacting the top micro switch stopping the motor and activating the long delay. The unloading function is accomplished mechanically by the bailer contacting the bailer stop pulling an actuating rod which through a trough linkage tilts the unloading trough under the bailer striking a dart at the bottom of the bailer emptying the contents of the bailer into an oil receiver.

10 Claims, 9 Drawing Figures

BAILER PUMPS FOR OIL WELLS

BACKGROUND OF THE INVENTION

Field of the Invention

An oil well pump consisting of components for propelling an elongated bucket type bailer into a well withdrawing the bailer and dumping the bailer contents into a receptacle.

DESCRIPTION OF PRIOR ART

Heretofore, pump jacks actuating sucker rods operating a down hole pump was the most widely used method of pumping deep wells. Air and gas chambers have been used and air and gas actuating devices are employed to actuate sucker rods. The novel device of this invention is related to the ancient windlass, rope, and bucket concept used in association with water wells. Automatic pumping and bailing devices have been developed and patented; such as U.S. Pat. Nos. 298,344 to Boyakin, and Van Ness, 307,243, and the automatic, reversible hoist of Ross, 1,486,923. Bailers or buckets have been employed in the past, such as Mapes, 1,145,158; Miller, 1,523,604; and Taylor, 2,144,669, Re. 21,565.

SUMMARY OF THE INVENTION

The bailer pump of this invention employs a bailer bucket similar to existing structures; the new structure is the combination of those components employed to propell the bailer into the well hesitating to permit loading, drawing the bailer out of the well, hesitating and unloading, and returning the bailer to the well. The principal components are the stan pipe secured to a well head upon which is secured a top plate to which is secured an axle mounted in pillow blocks carrying a spring loaded pivot arm to which is secured a pulley over which a cable passes. The tilting pivot arm contacts a short delay micro switch activating a short delay timer and relay to retain the bailer in the well for filling. The reversing of the electric motor winds the bailer out of the well; when the bailer is at the top of the stan pipe a bailer stop is contacted which contacts the top long delay micro switch delaying the bailer for unloading. A mechanical linkage attached to the bailer stop moves a control rod tilting the unloading trough under the bailer striking the dart unloading oil from the bailer. Any over travel would activate a kill switch shutting off the system. In normal operation after the long delay is completed the reversing relay would cause the motor to again be propelled back into the well. In association with the motor and the reduction gear drive train for the cable reel there is employed a magnetic brake to prevent the rotation of the gear train and reel when the current to the motor is shut off. This insures the bailer remaining stationary while unloading.

DESCRIPTION OF THE PREFERRED EMBODIMENT

Figure 1:
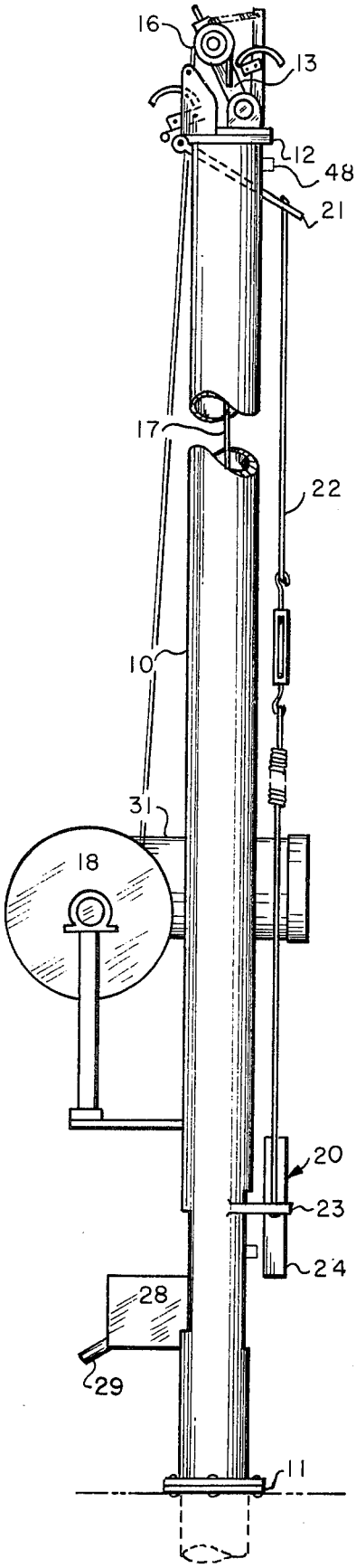
FIG. 1 is an elevation view of the device in position on a well head with the bailer in the well.

For a detailed description of the preferred embodiment reference is made to the drawings and the following detailed description wherein identical reference characters are employed to refer to identical or equivalent components throughout the various views and the following detailed description.

Figure 2:
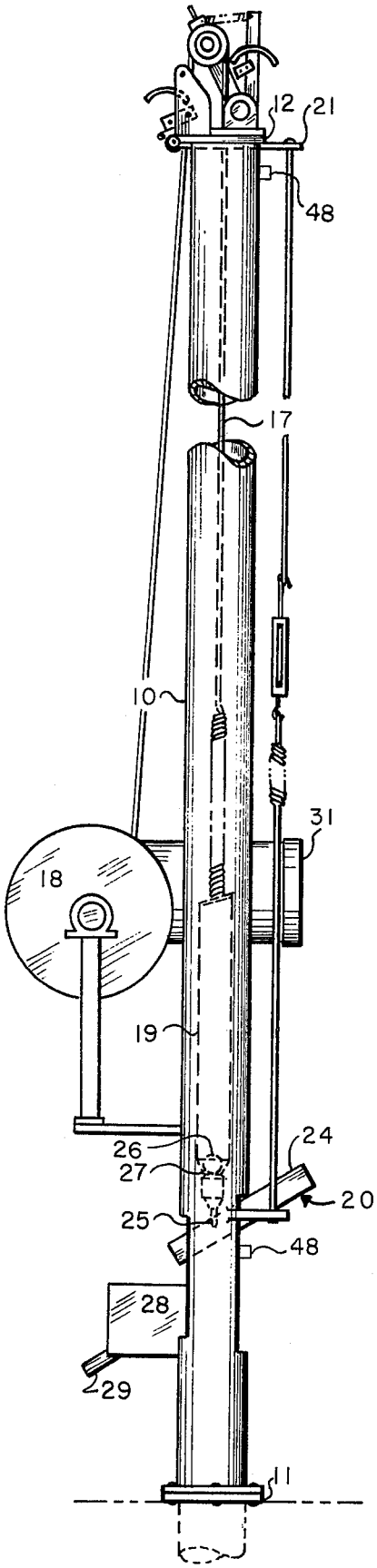
FIG. 2 is an elevation view of the device with the bailer reeled from the well in the unloading position.

For a general description of the device reference is made to FIGS. 1 and 2. In the preferred embodiment the stan pipe 10 was constructed from 4 ½ inch outside diameter hollow tubing 10 feet 6 inches long. Stan pipe 10 was bolted to a conventional well head 11 which was secured to the oil well casing (not shown). Bolted to the top of the stan pipe 10 was a 6 inch by 6 inch top plate 12. For a description of the components mounted on the top plate 12 reference is particularly made to FIGS. 4 and 5. Pivot arm 13 was constructed from ¼ inch by 2 inch by 8 inch steel plate. The pivot arm 13 was secured to an axle 14 for the pivot arm 13 mounted in pillow blocks 15 securing the pivot arm 13 in a tiltable position on the top plate 12. Rotatably secured on the top end of pivot arm 13 was a top pulley 16, 3 ½ inches in diameter. A length of braided steel cable 17 which was plastic coated passes over the top pulley 16 and was wound around a 4 inch long reel 18 for the cable. The cable 17 from reel 18 pass over the top pulley 16 and is secured to the bailer 19 which moves internal of stan pipe 10 into the oil well (not shown).

Figure 3:
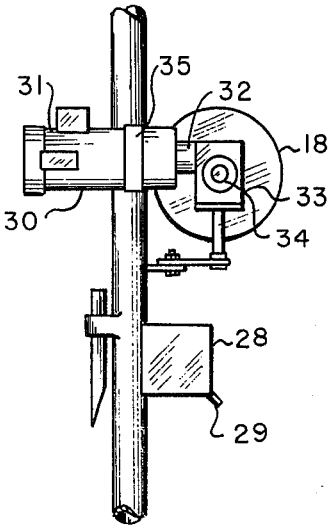
FIG. 3 is a fragmented view of the reel mechanism showing the reverse of FIG. 1 and FIG. 2.

For an illustration of the mechanical dump 20 and the associated mechanisms reference is particularly made to FIG. 2. The principal components of the mechanical dump 20 comprises the bailer stop 21 which is movably mounted internal of the stan pipe 10 securely attached to bailer stop 21 is actuating rod 22. In the preferred embodiment the bailer stop 21 was a circular piece of metal approximately ¼ inch thick with a hole in the center through which cable 17 passed. This aperture in the bailer stop 21 permitted cable 17 to freely propell bailer 19 into and out of the oil well. The actuating rod 22 was attached through a trough linkage 23 which tilted the metal unloading trough 24 underneath the bailer 19 striking dart 25 lifting the ball 26 from the ball seat 27 permitting the oil to flow from the bailer 19 into the oil receiver 28. The oil receiver 28 was a 4 inch by 8 inch by 8 inch metal box-like structure. An oil spout 29 may be provided from the oil receiver to flow the oil into a tank or other type receptacle. For an illustration of the foregoing oil receiver components and the drive components for reel 18 reference is particularly made to FIG. 3. Securely attached to stan pipe 10 is a motor mount 30 upon which is mounted a reversible, electric motor 31. In the control configuration of the preferred embodiment reversing of this electric motor 31 was accomplished by reversing the power leads supplying current to the motor 31. Projecting from the motor was the drive shaft 32 leading through a gear box 33 which through a right angle drive rotates reel shaft 34 driving the reel for cable 18. Intermediate electric motor 31 and gear box 33 was mounted a magnetic brake 35. This brake 35 is activated when the flow of current to the electric motor 31 is interrupted. The function and purpose of this magnetic brake 35 is to retain the bailer 19 in a stationary position for loading in the bottom of the well and for unloading at the well head 11. It should be understood that the relative arrangement of the foregoing components might be varied and accomplish the same general results; however, the foregoing illustrated arrangement of the components in the preferred embodiment is a satisfactory way to accomplish the purpose of this invention.

Figure 4:
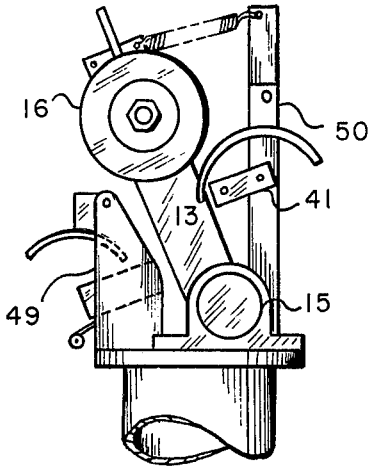
FIG. 4 is an elevation view of the control components mounted at the top of the stan pipe illustrating principally the pivot arm and the short delay switch.

For a description of the various electrical components used in the electrical control assembly 39 reference is particularly made to FIGS. 4–7. Substantial number of the electrical components are mounted in the control housing 40. The control assembly 39 is activated by contacting of the top bailer micro switch 46 to initiate lowering of the bailer 19 in the oil well and a contacting of top pulley micro switch 41 initiates the withdrawing of the bailer 19 from the well. Top pulley micro switch 41 is a small, push button-type activated switch mounted adjacent pivot arm 13. This contacting is caused by a releasing of tension of cable 17 passing over top pulley 16. When bailer 19 strikes oil in the well spring 42 for pivot arm 13 pulls top pulley 16 and pivot arm 13 to the right as illustrated in FIG. 4 contacting top pulley micro switch 41. This contacting through an appropriate wiring harness energizes the bottom time delay 43. These time delays may be plug in tube-type structure such as manufactured by Dayton Electric Manufacturing Company, Part No. 5X829 or any of the widely available by metal point contact make and break circuit time delays might be employed. Another time delay found to operate satisfactorily was Amperite No. 115-C-30. Adjustable time delays might be employed or a preselected fixed time delay is satisfactory. Time delays are also manufactured by Essex are BM Type 187 Electronic Time Delays are susceptible of use. Bottom time delay 43 in the preferred embodiment was generally referred to as a short delay. In conjunction with the bottom time delay 43 single pole coil activated double throw power relay 44 was employed. Such a relay is available from Magnacraft Electric Company, 5575 North Lynch, Chicago, Illinois, Parts Numbers W99AX5 and W588CPX20. A large variety of relays susceptible to use are available commercially by such manufacturers as Essex Control Division, 131 Godfrey Street, Logansport, Indiana. The power relay 44 as well as reversing switch 45 may be of identical construction. The only difference in function resulting from the manner in which the relays 44 and 45 are wired into the overall system. The foregoing described components essentially control the operation of the device of this invention when the bailer 19 strikes oil in the bottom of the oil well.

Figure 5:
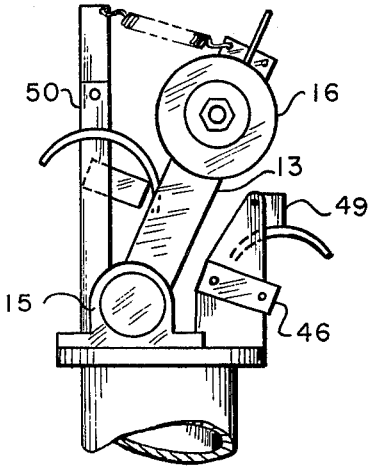
FIG. 5 is a reverse of FIG. 4 illustrating the long delay micro switch which operates in conjunction with the bailer stop.
Figure 6:
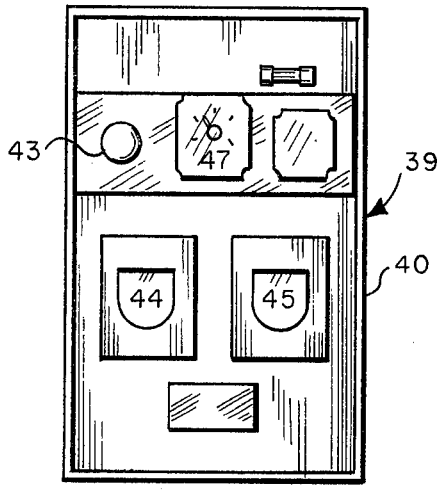
FIG. 6 is a plan view partially schematic of the electrical components in the control box illustrating the relative arrangement of the electrical components including the short delay timer, the long delay timer, the power relay, and the reversing switch.
Figure 7:
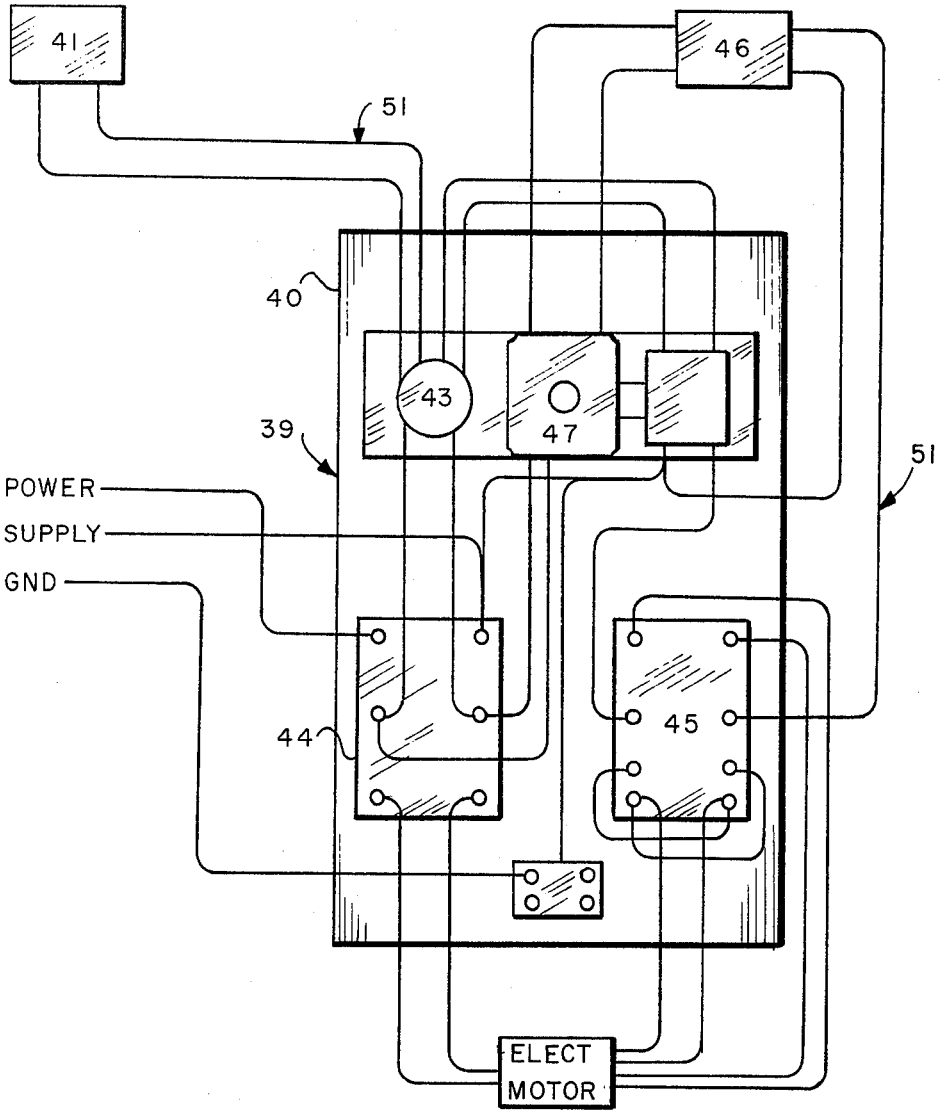
FIG. 7 is a schematic wiring diagram of the system of the preferred embodiment.

The control function at the well head 11 consists principally of top bailer micro switch 46 illustrated in FIG. 5 and related components. The contacting of top bailer micro switch 46 caused by the bailer 19 contacting bailer stop 21 activates time delay bailer top 47. The contacting of the top bailer micro switch 46 is similar to the action as previously described activating time delay bailer top 47, power relay 44 and reversing switch 45. The time delay bailer top 47 in the preferred embodiment was referred to as the long time delay. Ordinarily, a short delay of 30 seconds in the bottom of the well was sufficient for loading bailer 19. However, the unloading time for the bailer 19 at the top of the well was approximately 60 seconds. As previously stated, a variable time delay might be employed which are adjustable or fixed time delays solving a particular pumping situation may be selected. In association with bailer stop 21 or the actuating rod 22 incorporated in the system was safety kill switch 48, a toggle-type switch so connected and positioned that if actuating rod 22 travelled approximately ¼ inch past the point when top bailer micro switch 46 was contacted the toggle-type safety kill switch 48 was tripped interrupting the flow of electric current to drive mechanism of the device until the safety kill switch 48 was manually restored to its operable position and the difficulty corrected. Kill switch 48 prevents overrunning of electric motor 31 resulting in a breaking of cable 17 by an over rotation of reel for cable 18. The device of this invention was designed to operate continually unsupervised in an oil field. Additional components illustrated principally in FIGS. 4–5 are pivot arm stop 49 which was constructed of ¼ inch thick, 2 inches wide plat bar steel stock 4 inches long and welded to top plate 12 in substantially the manner illustrated in FIGS. 4 and 5. Projecting upward from top plate 12 was a ½ inch thick, 1 inch wide, 10 inches long spring support 50. The spring support 50 served as suitable mount for top pulley micro switch 41 as well as spring for pivot arm 42 to load the pivot arm 13 in an operable arrangement.

Figure 8:
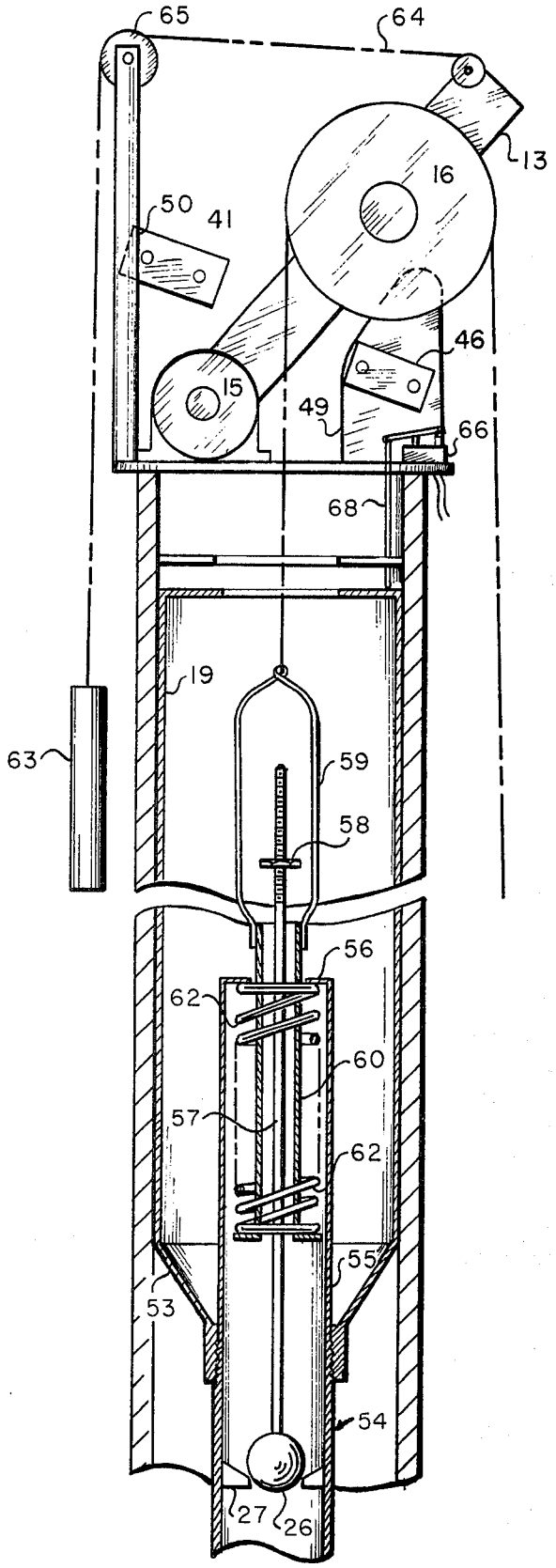
FIG. 8 is a plan view partially fragmented and sectional of an embodiment of the device using a spring loaded ball and seat dumping mechanism.
Figure 9:
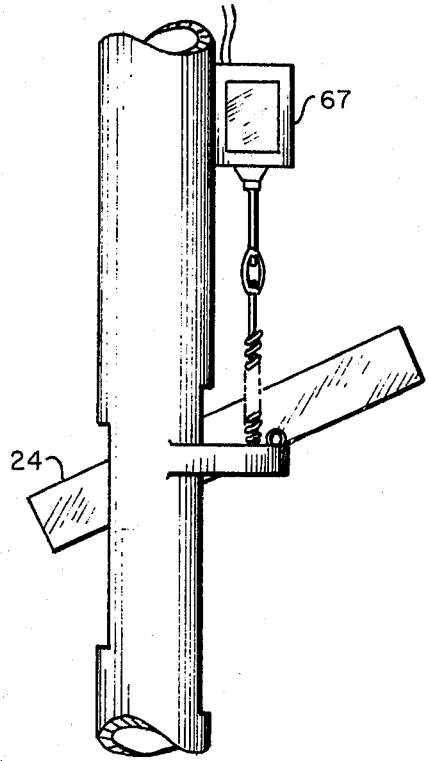
FIG. 9 is a fragmented view of a solenoid activated unloading trough.

A modification of the device found to be particularly desirable in heavy crude is a modified dump device as illustrated in FIG. 8 and FIG. 9. This modified version has proven desirable when the bailer 19 is permitted to emerse deep into the crude. The close tolerance between the bailer 19 and the well casing, not shown, creates an extreme load on cable 17, this modified bailer 19 relieves some of the tension by bleeding off a portion of the crude past the ball 26 and seat 27. This modified version may be constructed in the bottom portion of bailer 19 in the following manner. A funnel shaped collar 53 tapering from 3 ½ inches I.D. is welded to the bottom of the bailer 19. This funnel shaped collar 53 tapers to a diameter of approximately 2 inches at its bottom end. The spring loading assembly 54 threadably engages the inside of collar 53. The outer housing 55 of the spring loading assembly 54 is 1 ½ inches O.D. projecting upward from collar 53 into the interior of bailer 19. At the top extremity of the outer housing 55 projecting inward is the upper spring retaining flange 56. At the bottom of housing 55 is constructed a circular ball seat 27 closed by ball 26. Projecting upward from ball 26 is an elongated ball rod 57 projecting through the length of housing 55. The top edge of ball rod 57 is threaded upon which is mounted an adjusting nut 58. Mounted internal of housing 55 encasing the ball rod 57 is a spring sleeve 60 having a lower spring retaining flange 61 flaring outward closely adjacent to the inside diameter of housing 55. Lift spring 62 fits between the upper spring retaining flange 56 and the lower spring retaining flange 61. Cable bale 59 is securely attached to the upper extremity of spring sleege 60 with cable 17 attached.

Another modification incorporated in this second embodiment was the utilization of a pivot arm tension weight 63 in combination with a pivot arm tension cable 64 and a pivot arm tension pulley 65 as a substitute for the spring for pivot arm 42. One advantage of the weight 63 is more constant tension over a period of time and less temperature affect.

In the modified bailer of FIG. 8 a modified form of the unloading trough 24 was employed. A mechanical trough linkage 23 of the first embodiment was modified to utilize a solenoid 67 to position the trough 24 into position for unloading the bailer 19. The solenoid 67 is illustrated in FIG. 9 and was energized by solenoid micro switch 66 mounted on the top plate 12 as substantially illustrated in FIG. 8.

OPERATION OF THE DEVICE

As indicated in the abstract and summary of the invention, the purpose of this invention is to automatically propell a bailer 19 into an oil well permitting it to fill withdrawing the bailer from the well and unloading the bailer at the well head 11. For an illustration of the operable cycle let us assume the bailer 19 is being unreeled into an oil well. When bailer 19 strikes the oil in the well the relatively small distance between the bailer 19 and the casing of the oil well causes the bailer to temporarily tend to float. This action slackens the tension on cable 17 permitting pivot arm 13 to be tilted by spring for pivot arm 42 causing contact of top pulley micro switch 41. This contact activates bottom time delay 43 and through wiring harness 51 through the coils of power relay 44 interrupts the flow of current to reversible electric motor 31 simultaneously reversing switch 45 is activated changing the direction of flow of current to reversible electric motor 31. After an appropriate time delay of approximately 30 seconds the system is energized and the electric motor 31 through the drive mechanism rotates reel for cable 18 withdrawing the bailer 19 from the well. As the bailer 19 approaches the top of stan pipe 10 the bailer 19 strikes bailer stop 21 contacting top bailer micro switch 46. This contact activates time delay bailer top 47 again energizing power relay 44 and reversing switch 45 simultaneously energizing magnetic brake 37 to retain the bailer 19 in position for unloading. In conjunction with this movement of the bailer stop 21 actuating rod 22 is pulled, moving trough linkage 23 and projecting the unloading trough 24 underneath bailer 19 striking dart 25 unseating ball 26 from ball seat 27 unloading the content of bailer 19 into oil receiver 28. After the elapse of predetermined time delay bailer top 47, the system is again energized to return the bailer 19 to the oil well.

The second embodiment of bailer 19 having a ball 26 and seat 27 which is unloaded by tension on cable 17 compressing spring 62 dumps in a manner similar to the first embodiment. When bailer 19 is brought into contact with stop 21 for an instant the reel 18 continues to operate. The tensioning of cable 17 compresses spring 62 and spring sleeve 60 extends upward striking adjusting nut 58 lifting ball 26 from seat 27. Simultaneously the bailer 18 contacts micro switch rod 68 activating solenoid micro switch 66 which energizes solenoid 67 bringing the unloading tray 24 under the bailer 19 to deliver the oil to the oil receiver 28. The controls for the reversible electric motor 31 including bottom timed delay 43 and time delay bailer top 47 and related components are as previously described.

Bailer pumping mechanism of this invention has been found to operate particularly satisfactorily in heavy crude from the sand bearing strata in relatively shallow stripper wells near Hondo, Texas. Pump jacks with down hole pumps encountered substantial difficulty in this field due to the thick, low viscosity of the crude. This in combination with sand particles made the operation of down hole pumps difficult. The splashing action of the bailer 19 striking the crude tends to clean the perforations in the well casing and in association with other factors resulted in highly acceptable production. Elongated stan pipes with bailers or increased length may be employed for increased pumping capacity. It is realized that the various components might be arranged in different configurations. Electrical controls also are susceptible of some modification without departing from the scope and spirit of this invention.

What is desired to be claimed are all embodiments not departing from the scope of equivalents of this invention as defined in the appended claims.

I claim:

1. A stripper bailer for oil wells comprising:

a. an elongated stan pipe having a top end and a well head end adapted to be secured to a well head, b. a bailer mounted on said stan pipe, c. a powered reel for propelling said bailer into and out of an oil well, d. a cable wound on said reel and attached to said bailer, e. a reversible motor operable engaging said reel for powering said reel, f. a pivot arm tiltably mounted on said stan pipe, g. a pulley rotatably mounted on said pivot arm, said pulley receiving said cable intermediate said reel and said bailer, h. a first switch in association with said pivot arm for stopping and reversing said motor; and first switch operating responsive to the tilting of said pivot arm, i. a first time delay means in operable association with said first switch causing a predetermined time delay when said motor is stopped, j. dumping means for emptying said bailer at a well head, and k. a wiring harness means interconnecting the electrical components.

2. The invention of claim 1 further comprising:

a. a second switch in association with said dumping means for stopping and reversing said motor, said switch operating responsive to said bailer arriving at a well head, and b. a second time delay means in operable association with said second switch when said motor is stopped.

3. The invention of claim 1 wherein said first time delay and said second time delay are electrical time delays and are conductively connected to said first switch and said second switch.

4. The invention of claim 1 wherein said reversible motor is an electric motor capable of being reversed by switching leads of an external power supply.

5. The invention of claim 1 further comprising a magnetic brake intermediate said motor and said reel for retaining said reel in a fixed position when said motor is stopped.

6. The invention of claim 1 wherein said dumping means comprises:

a. a bailer stop adjacent the said top end of the said stan pipe, b. an actuating rod secured to said bailer stop, said rod moving responsive to the contacting of said bailer stop by said bailer, said actuating rod linkingly attached to, c. an unloading tray, said bailer being dumped responsive to contacting by said unloading tray.

7. The invention of claim 1 further comprising a kill switch positioned to be contacted in the event said bailer overtravels in the direction of the said top end of said stan pipe.

8. The invention of claim 4 further comprising a coil activated relay reversing the leads of the external power supply connected to the said reversible electric motor.

9. The invention of claim 1 wherein said dumping means comprises:

a. a bailer stop adjacent the said top end of the stan pipe, b. a lift spring internal of said bailer which is placed under load responsive to tension on said cable, c. the loading of said lift spring lifting a ball from a ball seat mounted in the bottom of said bailer.

10. The invention of claim 1 wherein said dump means comprises:

a. a solenoid micro switch contacted by said bailer arriving at the top end of said stan pipe, b. a solenoid attached to, c. an unloading tray, said unloading tray moving into said stan pipe and under said bailer responsive to energizing of said solenoid, and d. the said wiring harness interconnecting the said solenoid micro switch and the said solenoid.

* * * * *